US005785195A

United States Patent [19]

Zwemer et al.

[11] Patent Number: 5,785,195

[45] Date of Patent: Jul. 28, 1998

[54] CONICALLY THREADED CLOSURE SYSTEM

[75] Inventors: Andrew P. Zwemer, Alamo; Thomas Gerret Dewees, Pleasanton, both of Calif.

[73] Assignee: The Clorox Company, Oakland, Calif.

[21] Appl. No.: 745,100

[22] Filed: Nov. 7, 1996

[51] Int. Cl.[6] ..... B65D 41/04

[52] U.S. Cl. ..... 215/329; 215/44; 215/321; 215/349; 220/288; 220/289

[58] Field of Search ..... 215/44, 45, 318, 215/321, 329, 341, 349, 330, 331; 220/288, 293, 295, 296, 289

[56] References Cited

U.S. PATENT DOCUMENTS

| | | | |
|---|---|---|---|
| 3,465,923 | 9/1969 | Konefal | 215/321 X |
| 3,582,535 | 6/1971 | Appleton | 220/288 X |
| 3,743,800 | 7/1973 | Appleton et al. | 220/288 X |
| 4,193,509 | 3/1980 | Dunn, Jr. et al. | 215/330 |
| 4,764,067 | 8/1988 | Kawashima | 411/310 |
| 4,798,303 | 1/1989 | Arnold | 215/329 |
| 4,958,973 | 9/1990 | Sugimura | 411/423 |
| 5,494,174 | 2/1996 | Rohr et al. | 220/289 X |
| 5,542,532 | 8/1996 | Mitchell | 215/329 X |
| 5,676,270 | 10/1997 | Roberts | 220/289 X |
| 5,713,479 | 2/1998 | Brady | 215/330 |

FOREIGN PATENT DOCUMENTS

| | | | |
|---|---|---|---|
| 642732 | 9/1928 | France | 220/288 |
| 2323561 | 11/1974 | Germany | 215/329 |
| 102465 | 12/1916 | United Kingdom | 220/288 |

*Primary Examiner*—Allan N. Shoap
*Assistant Examiner*—Robin A. Hylton
*Attorney, Agent, or Firm*—Francis Law Group

[57] ABSTRACT

A conically threaded closure system is described which provides a compressive radial force to axial force ratio in the range of 4.3–6.2:1, resulting in an optimum stress distribution throughout the thread structures, optimum thread engagement with minimal rotational effort and primary and secondary sealing means. The system comprises a container having a first conical thread structure and a cap having a second conical thread structure disposed on the inside surface of the cap skirt adapted to cooperate with the first conical thread structure. The first and second conical thread structures each have a conical angle in the range of approximately 20° to 30°, preferably approximately 24° to 28°.

19 Claims, 20 Drawing Sheets
(8 of 25 Drawing(s) in Color)

FIG. 3
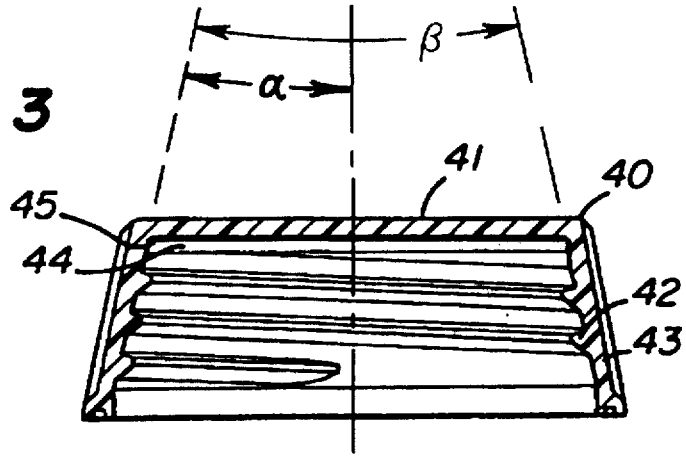
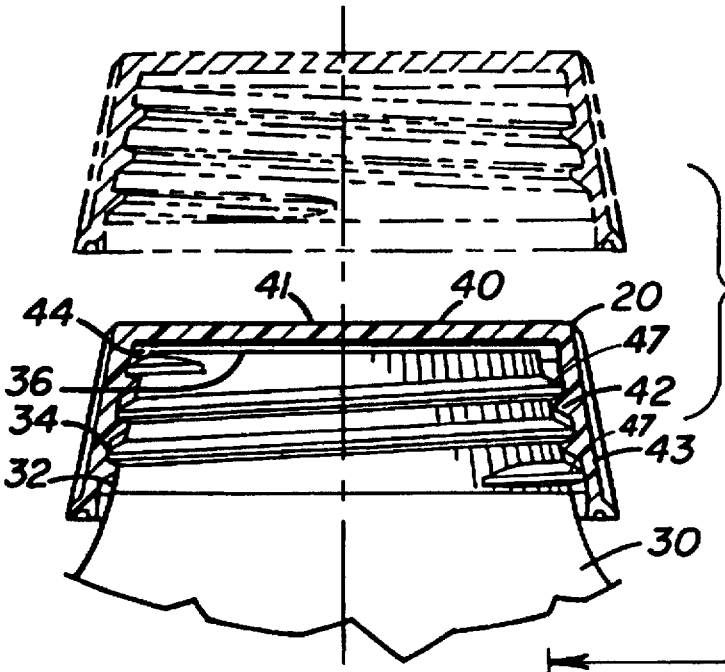
FIG. 2
FIG. 4
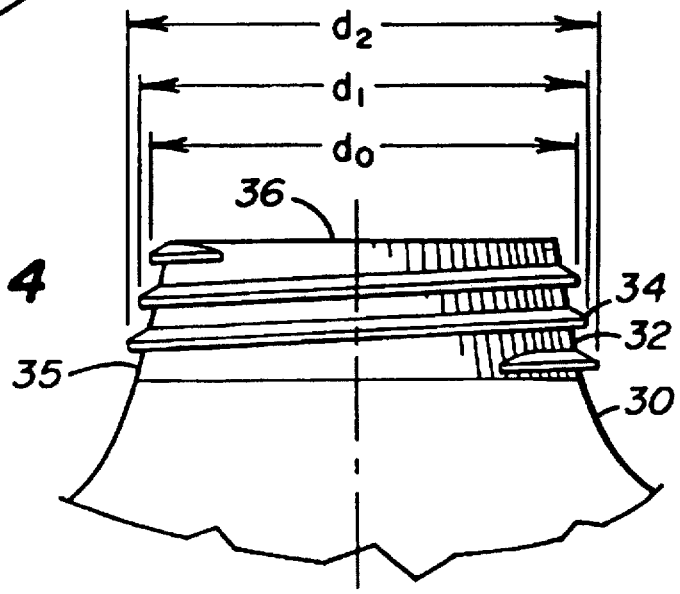

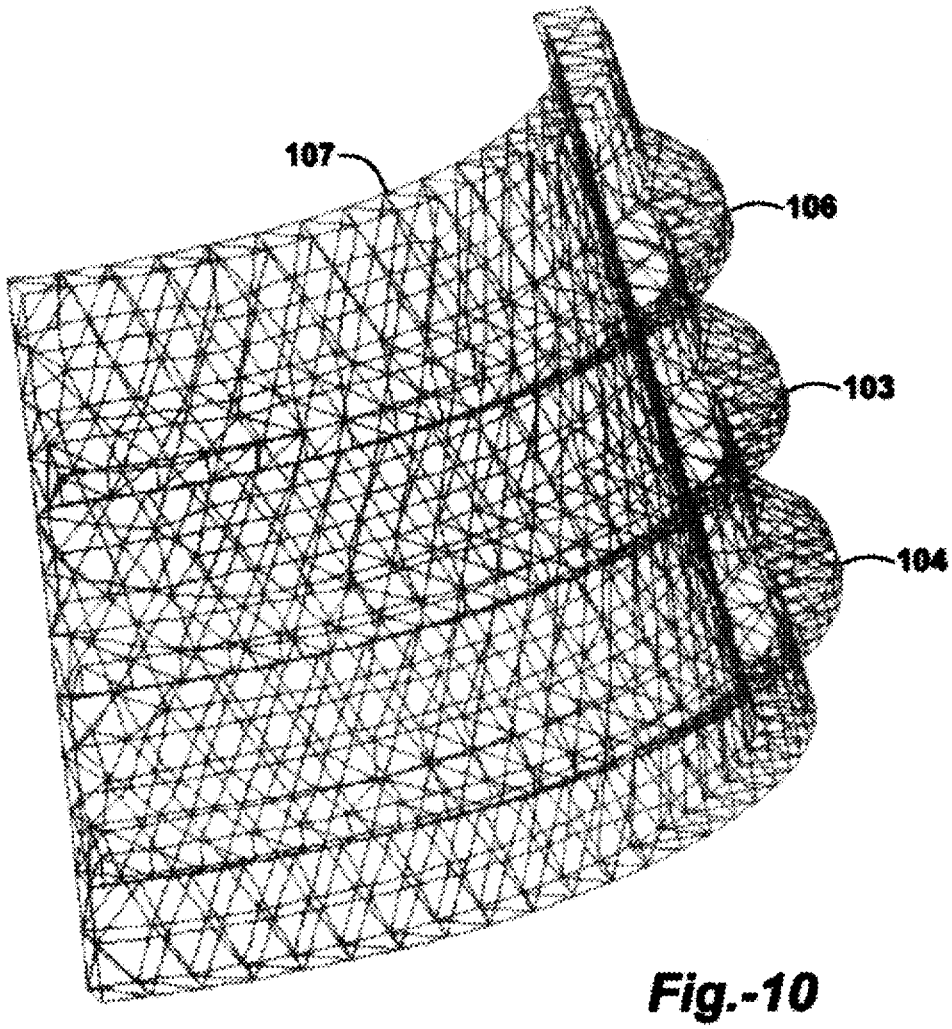
Fig.-10
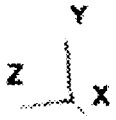

CONICALLY THREADED CLOSURE SYSTEM

FIELD OF THE PRESENT INVENTION

The present invention relates generally to threaded closure assemblies for bottles and containers. More particularly, the invention relates to a conically threaded closure system for obtaining secure thread engagement with optimum stress distribution.

BACKGROUND OF THE INVENTION

Threaded closure assemblies (container and cap) are well-known in the art. Generally, the container has a continuous cylindrical thread proximate the opening thereof. A screw cap is also provided which has an internal thread configuration adapted to cooperate with the container threads.

In an effort to overcome the problems associated with conventional cylindrical threads, various conical thread designs have been employed. Illustrative are the closure assemblies disclosed in German Application No. 2,323,561 and U.S. Pat. No. 4,798,303.

German Application No. 2,323,561 discloses a closure assembly having a multiple "saw-tooth" thread profile and a conical angle of 30°. According to the reference, sealing of the container can be obtained with a half turn. The seal is achieved by virtue of a depression in the cap engaging the opening in the neck of the container.

The noted assembly also has several drawbacks. Most significantly, the "saw-tooth" thread profile is inherently weak and tends to chip. Further, upon engagement of the cap, the tensile stresses in the threads are significant.

In U.S. Pat. No. 4,798,303 a continuous thread closure assembly having a conical angle of at least 40° is disclosed. Sealing of the assembly is also achieved at the container/cap interface in less than one turn of the cap. However, in this instance, two full turns of thread engagement between the container and the cap are achieved.

The thread design (i.e., modified buttress) and conical angle of the noted assembly also produces an undesirable stress distribution across the threads. As a result, the noted design is limited to rigid, higher strength materials (e.g., glass).

It is therefore an object of the present invention to provide an efficient closure system for containers which is readily sealed and removed with minimum effort and easy to fabricate.

It is another object of the invention to provide a conically threaded closure system having an optimum stress distribution about the cap and container thread structures.

It is another object of the invention to provide a conically threaded closure system having at least 2.5 thread engagement upon 1 to 1.5 turns of the cap.

It is yet another object of the invention to provide a conically threaded closure system having primary and secondary sealing means.

SUMMARY OF THE INVENTION

In accordance with the above objects and those that will be mentioned and will become apparent below, the conically threaded closure system in accordance with this invention comprises a container having a first conical thread structure and a cap having a second conical thread structure disposed on the inside surface of the cap skirt adapted to cooperate with the first conical thread structure. The first and second conical thread structures each have a conical angle in the range of approximately 20° to 30°. The first and second conical thread structures provide primary and secondary sealing means upon engagement of the cap by the container.

In a preferred embodiment of the invention, the first and second conical thread structures also provide a ratio of radial compressive force to axial force in the range of approximately 4.2 to 6.3:1.

The advantages of this invention include (i) optimum thread engagement with minimal effort, (ii) substantial reduction or elimination of problems generally associated with container and cap creep, and (iii) primary and secondary sealing means.

BRIEF DESCRIPTION OF THE DRAWINGS

The file of this patent contains at least one drawing executed in color. Copies of this patent with color drawings will be provided by The Patent and Trademark Office upon request and payment of the necessary fee.

Further features and advantages will become apparent from the following and more particular description of the preferred embodiments of the invention, as illustrated in the accompanying drawings, and in which like referenced characters generally refer to the same parts or elements throughout the views, and in which:

FIG. 2 is a fragmentary cross-sectional view of the conically threaded closure system of the invention illustrating the position of the cap and container prior to engagement;

FIG. 3 is a cross-sectional view of an embodiment of a cap according to the invention;

FIG. 4 is a plan view of an embodiment of a container according to the invention illustrating a conical thread structure;

FIG. 10 is a computer generated model of a container thread structure;

DETAILED DESCRIPTION OF THE PREFERRED EMBODIMENT

The disclosed conically threaded closure system substantially reduces or eliminates the disadvantages and shortcomings associated with prior art threaded closure assemblies.

According to the invention, a container having a continuous conical thread structure and a cap having a conical thread structure adapted to cooperate with the container thread structure are provided to achieve a secure, efficient closure with minimal effort. A highly important technical advantage of the invention is the optimum stress distribution (i.e., profile) of the conical thread structures.

Figure 1:
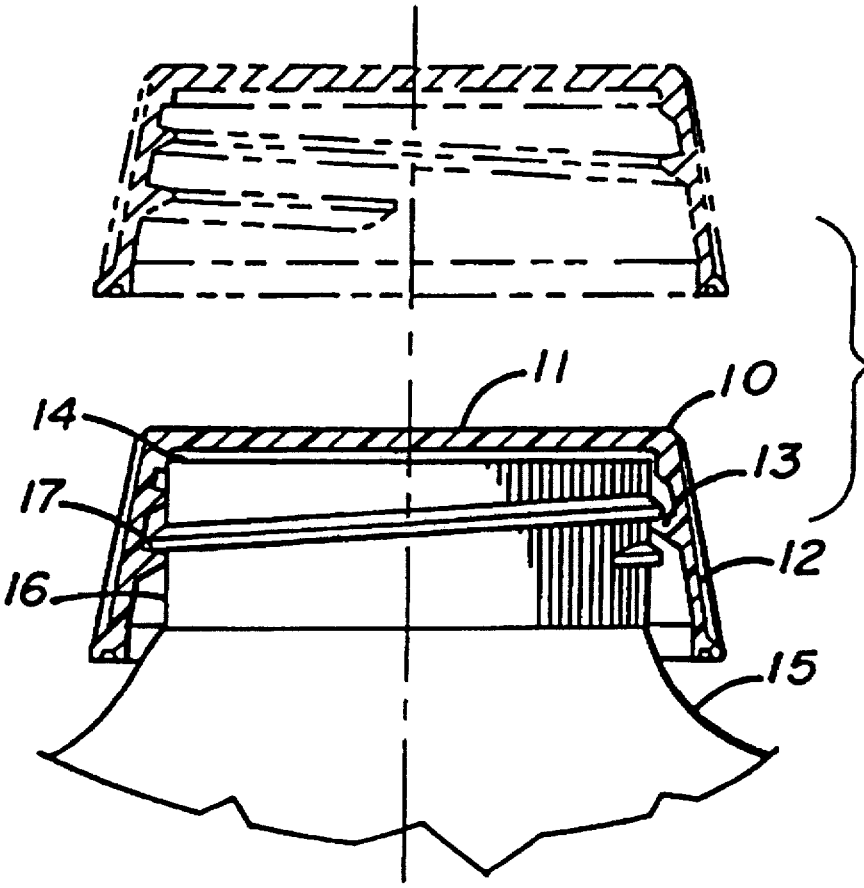
FIG. 1 Prior Art
FIG. 1 is a fragmentary cross-sectional view of a prior art cylindrical thread closure assembly.

Referring to FIG. 1, there is shown a conventional cap 10 and container 15 assembly. The cap 10 comprises a top 11 and a cap skirt 12 having threads 13 formed on the inner surface thereof. A compressible liner 14 is typically placed on the inner surface of the cap top 11 to facilitate sealing.

The container 15 includes a thread portion 16 having a continuous thread structure 17 on its outer surface. The thread structure 17 is adapted to cooperate with threads 13 on the inner surface of the cap skirt 12.

As illustrated in FIG. 1, the container threaded portion 16 and the cap skirt 12 are generally cylindrically shaped. Thread engagement with the noted configuration is also typically limited to 1.0 to 1.5 threads.

There are several problems associated with the assembly illustrated in FIG. 1. Most significantly, since only 1.25 threads are employed to bear the load (or forces) in the assembly, the resultant stresses in the cap and container threads 13, 17 are significant. Moreover, virtually all of the load is applied at the inner edge of the lower cap threads.

Further, if the cap threads are not properly engaged with the container threads, "cross-threaded" or "cocked" caps can occur with the noted cylindrical configuration. Such caps can result in container leakage when the user does not take ordinary care to align the closure (i.e., cap) threads with the container threads.

Referring to FIG. 2, there is shown the conically threaded closure system 20 of the invention. The system 20 includes a container 30 having a continuous conical thread structure 34 and a cap 40 having a conical thread structure 42 adapted to cooperate with the container threads 34.

The cap 40 includes a top 41 and a cap skirt 43 having a thread structure 42 formed on the inner surface thereof (see FIG. 3). According to the invention, various thread configurations may be employed. In a preferred embodiment, the thread structure 42 has a conventional buttress thread profile.

According to the invention, the cap 40 is constructed of a polymeric material, such as a thermoplastic material. Preferably, the cap is constructed of polyethylene or polypropylene.

As will be appreciated by one having ordinary skill in the art, the cap 40 can be constructed of various polymeric and metallic materials. Indeed, as discussed in detail below, by virtue of the container and cap thread structures 34, 42, the cap 40 can comprise a low density (i.e., softer) polymeric material.

According to the invention, when the cap 40 is fully engaged by the container 30, primary and secondary sealing means, discussed in detail below, are achieved. The term "primary sealing", as used herein, is meant to mean sealing of the cap 40 and container 30 assembly proximate the inner surface 45 of the cap top 41 and the container 30 opening 36. The term "secondary sealing", as used herein, is meant to mean sealing of the cap 40 and container 30 assembly proximate the thread structures 34, 42, indicated generally 47 in FIG. 2.

As illustrated in FIG. 2, in a preferred embodiment, the primary sealing means comprises a compressible liner 44 disposed on the inner surface 45 of the cap top 41. In additional embodiments of the invention, not shown, the primary sealing means is achieved by virtue of the contacting interface between the inner surface 45 of the cap top 41 and the container opening top surface 36.

As illustrated in FIG. 3, the cap skirt 43 is conically shaped (viewed perspectively) to achieve the advantages of the invention. According to the invention, the conical (i.e., included) angle $\beta$ of the cap skirt 43 and the thread structure 42 disposed thereon, is in the range of approximately 20° to 30°, preferably approximately 24° to 28°. In a preferred embodiment, the conical angle of the cap skirt 43 is approximately 26°. The conical angle $\beta$ (or conical thread angle), as used herein, is meant to mean twice the angle to the vertical axis Y (i.e., $2\times\alpha$) (see FIG. 3).

As discussed in detail below, Applicants have found that the preferred conical angle in the range of 24° to 28° provides an optimum stress distribution across the conical thread structures 34, 42. The noted conical angle further provides optimum primary and secondary sealing.

Referring to FIG. 4, the container 30 includes a thread portion 32 preferably having two and one-half (2.5 ) full turns of a continuous conical thread structure 34 on its outer surface 35. The thread structure 34 is designed and adapted to cooperate with the thread structure 42 on the inner surface of the cap skirt 43.

According to the invention, the container 30 thread structure 34 is constructed of a polymeric material, such as a blown thermoplastic, preferably, high density polyethylene. However, as will be appreciated by those having skill in the art, various conventional materials may be employed within the scope of the invention.

As illustrated in FIGS. 2 and 4, the container thread structure 34 has a thread configuration which is readily accommodated by the thread structure 42 of the cap 40. In a preferred embodiment, the container 30 and cap 40 thread structures 34, 42 are substantially matched to achieve the advantages of the unique closure system.

As illustrated in FIG. 4, the major diameter "d" of the thread structure (or thread) 34 generally increases from $d_0$ to $d_2$ (i.e., increasing in a direction away from the container outlet 36), resulting in a generally conical shape. The conical (i.e., included) angle of the threads 34 (and container thread portion 32) is similarly in the range of approximately 20° to 30°, preferably approximately 24°–28°. In a preferred embodiment, the conical angle of the threads 34 is substantially similar to the cap thread structure 42 (i.e., approximately 26°) to facilitate the engagement of the thread structure 42 on the inner surface of the cap skirt 43 and achieve the primary and secondary sealing of the system 20.

It will also be appreciated by those skilled in the art that a lower thread pitch (as compared to conventional cylindrical threads) may be employed by virtue of the container 30 and cap 40 thread structures 34, 42. As a result, the applied torque (i.e., rotational effort of the cap 40) required to achieve a given sealing pressure on the container opening 36 is reduced. Indeed, Applicants have found that the applied torque can, in many instances, be reduced approximately 10%, as compared to conventional sealing systems, while maintaining the integrity of the seal.

Moreover, since the torque "error range" during processing (i.e., assembly) is typically a percentage of the applied torque, a reduction in the applied torque results in a narrower error range. Management of the applied torque during processing will thus be significantly improved.

Further, according to the invention, 2.5 threads are engaged by the cap 40 when the cap 40 is secured on the container 30 (see FIG. 2). This is preferably achieved in approximately 1.0 to 1.5 turns of the cap 40. Thus, the applied forces in the system 20 are distributed over twice as many threads as compared to conventional threads.

In addition, since the container 30 and cap 40 thread structures 34, 42 are substantially matched, substantially complete alignment of the cap 40 will be automatically achieved prior to the cap 40 entering the first set of threads. As a result, as long as the user appropriately combines the cap threads with the container threads "cross threaded" or "cocked" caps should be avoided.

As discussed in detail below, the preferred container 30 and cap 40 thread structures 34, 42 provide (i) optimum engagement of the threads 42, 34 with minimal rotational effort, (ii) primary and secondary sealing means, (iii) optimum force distribution and (iv) optimum stress distribution (i.e., profile) on the thread structures 42, 34.

Figure 6:
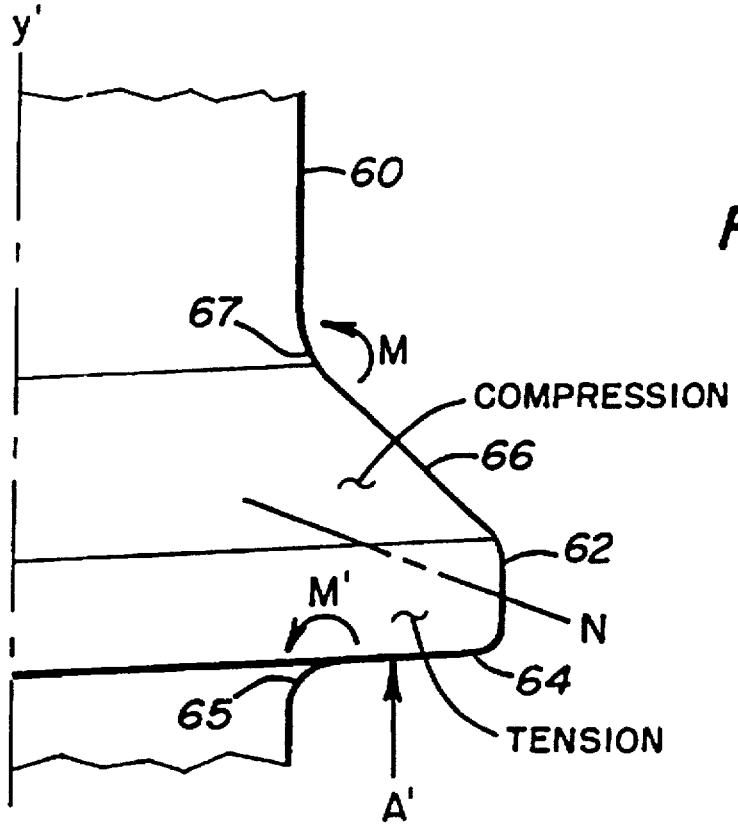
FIG. 6 is a schematic illustration of the thread structure shown in FIG. 5 on a vertical plane.
Figure 5:
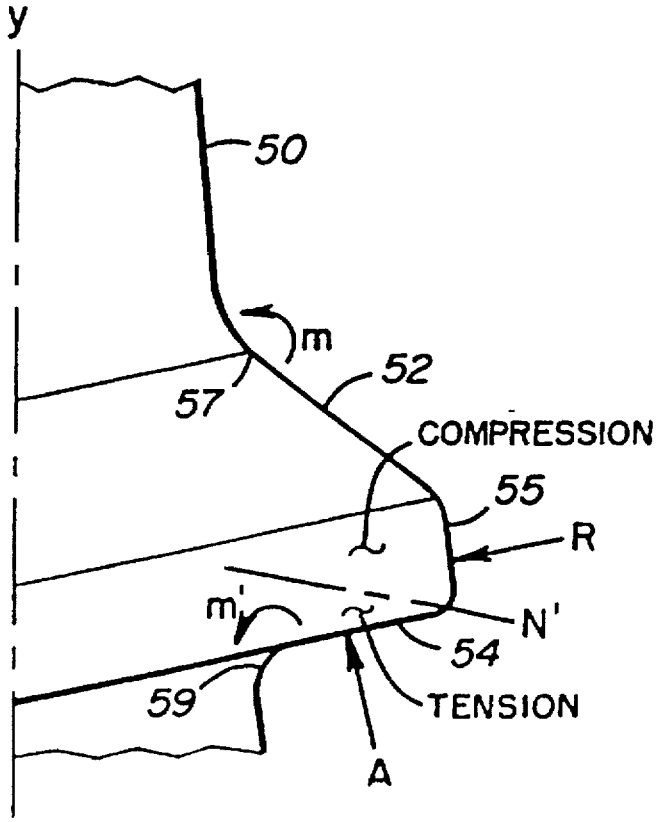
FIG. 5 is a schematic illustration of a conical thread structure showing the applied forces.

Referring to FIGS. 5 and 6, there are shown schematic illustrations of the force and, hence, stress distributions of the conical thread structure of the invention 52 and a conventional cylindrical thread 62, respectfully. The forces in a mating cap having a conical thread structure (as discussed above) would, of course, include forces equal and opposite to those noted in FIG. 5.

As illustrated in FIG. 6, the primary axial force A' in a conventional cylindrical thread 62 is applied to the primary thread face 64 in a direction substantially parallel to the longitudinal axis Y' of the container 60. As a result of the axial force A', the thread 62 exhibits a decreasing tensile stress distribution from the thread face 62 through the neutral axis N and an increasing compressive stress distribution from the neutral axis N through the secondary thread face 66.

The primary axial force A' would also produce moments M about point 67 and M' about point 65 (i.e., thread roots). The moment M would enhance the compressive stress(es) about point 67. Moment M' would enhance the tensile stress(es) and, hence, likelihood of shear, about point 65.

There are numerous problems associated with the stress distribution illustrated in FIG. 6. The most significant problems are the magnitude and distribution of the tensile stresses. It is well known that most materials exhibit a higher strength in a compressive mode as compared to a tensile mode. Thus, thicker and/or stronger materials are typically required to accommodate the tensile stresses.

When polymeric materials, such as thermoplastics are employed, the stresses introduce another significant problem—creep. For most materials, the creep or plastic deformation depends, not only upon the maximum stress value, but also upon the time elapsed before the load is removed. Creep is also influenced by temperature.

As will be appreciated by one having ordinary skill in the art, creep can, and in many instances will, have a significant impact on the performance of threaded closure systems employing polymeric materials. For example, premature disengagement (i.e., loosening) of mating threads and sealing surfaces is often associated with creep.

Referring to FIG. 5, it can be seen that the conical threads of the invention 52 provide an optimum stress distribution. The noted stress distribution is particularly beneficial for threads comprising polymeric materials.

As illustrated in FIG. 5, the primary axial force A is similarly applied to the primary thread face 54 and is generally in a direction substantially parallel to the longitudinal axis Y of the container 50. By virtue of the conical thread design, the thread 52 also exhibits a radial compressive force R (i.e., secondary loading) at the crest 55 of the thread 52 in a direction substantially perpendicular to the axis Y.

Figure 7C:
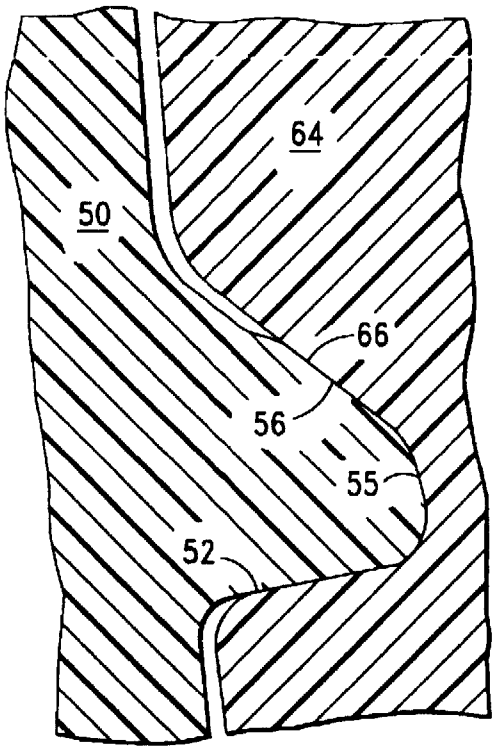
FIGS. 7A, 7B and 7C are simplified cross-sectional views of container/cap assemblies.
Figure 7B:
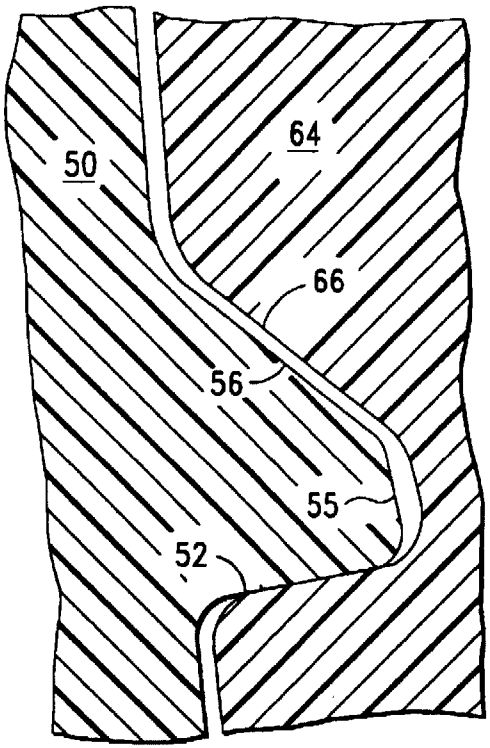
Figure 7A:
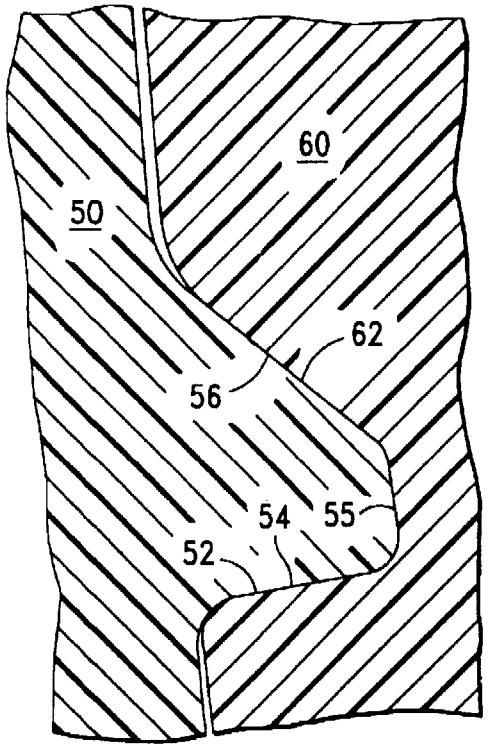

Referring now to FIGS. 7A, 7B and 7C, there are shown simplified cross-sectional views of container/cap assemblies, illustrating the secondary sealing means of the invention. For substantially matched container 50 and cap 60 threads 52, 62, respectively, the radial force R would enhance the frictional forces (and, therefore, sealing) between the threads 52, 62 proximate the crest 55 and upper surface 56 of the container threads 52 (see FIG. 7A).

For container 50 and cap 64 threads 52, 66 having excessive tolerances, such as that illustrated in FIG. 7B, the radial force R produces plastic flow of the container thread 52 proximate the crest 55 and upper surface 56 to seal the mating threads 52, 66 (see FIG. 7C). This is a key feature of Applicants' invention.

Further, as a result of the force distribution illustrated in FIG. 5, the portion of the thread 52 exhibiting a compressive stress substantially increases, shifting the neutral axis N' toward the primary thread face 54. The moments m and m' about points 57 and 59, respectively, are also substantially reduced or eliminated.

Moreover, as discussed in detail below, increasing the primary axial force A (i.e., tightening the cap) will produce a proportionate increase in the radial compressive force R. The relationship between the axial force A and radial compressive force R is a function of the thread angle θ (see FIG. 8).

Figure 8:
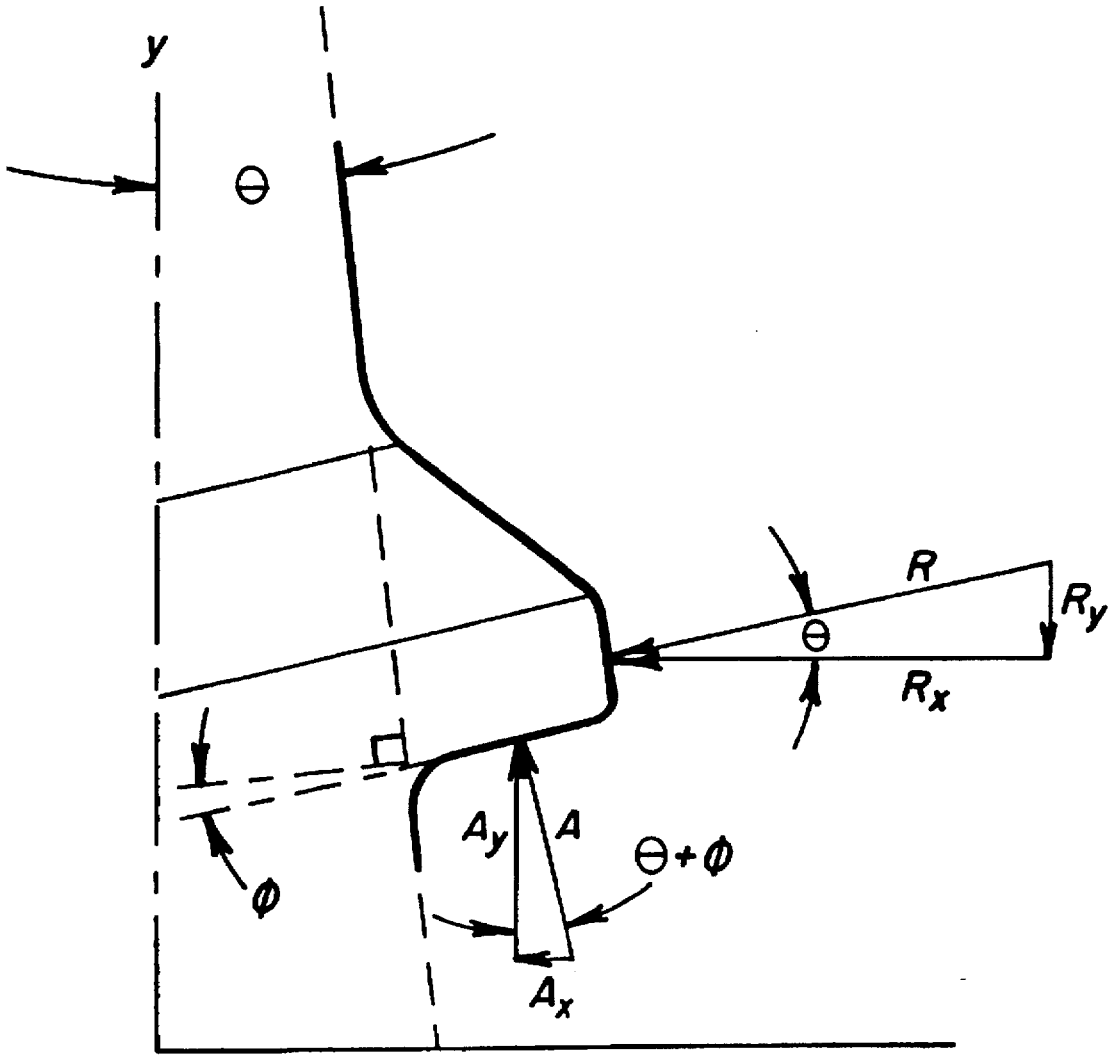
FIG. 8 is a schematic illustration of the thread structure shown in FIG. 5 showing the various components of the applied forces.

Referring to FIG. 8, there is shown a schematic illustration of the force distribution of a conical thread structure (or thread) 52 according to the invention, where:

A=axial force

R=radial compressive force

θ=thread angle (measured from longitudinal axis Y)

ϕ=thread face (i.e., helix) angle

For purposes herein, it is assumed that the shear forces and moments are in equilibrium.

As illustrated in FIG. 8, the radial compressive force R has two components; $R_x$ in the X direction and $R_y$ in the Y direction. Similarly, the primary axial force A has two components; $A_x$ in the X direction and $A_y$ in the Y direction. Since the conical thread structure 52 is in equilibrium under the action of the noted forces, we have $$\Sigma F_Y = A_Y + R_Y = 0 \quad (1)$$

$$\Sigma F_X = A_X + R_X = 0 \quad (2)$$

recognizing that $$A_Y = A \cos(\theta+\phi) \quad (3)$$

and $$R_Y = R \sin(\theta) \quad (4)$$

substituting equations (3) and (4) into equation (1), we have $$\Sigma F_Y = A \cos(\theta+\phi) + R \sin(\theta) = 0 \quad (5)$$

The radial force R, from equation (5), is thus $$R = \frac{-A\cos(\theta+\phi)}{\sin(\theta)} \quad (6)$$

To determine the ratio of total radial (compressive) force $F_R$ to incremental axial force A, we have $$\frac{F_R}{A_Y} \tag{7}$$

where:

$$F_R = R_X + A_X \tag{8}$$

and $$R_X = R \cos\theta \tag{9}$$

substituting equations (8), (9) and (3) into equation (7), we have $$\frac{F_R}{A_Y} = \frac{\cos\theta\left[\frac{A\cos(\theta+\phi)}{\sin\theta}\right]}{A\cos(\theta+\phi)} + \tan(\theta+\phi) \tag{10}$$

or $$\frac{F_R}{A_Y} = \frac{1}{\tan\theta} + \tan(\theta+\phi) \tag{11}$$

If $\theta=13°$ and $\phi=16°$, the ratio of the total radial compressive force $F_R$ to the total axial force A is $$\frac{1}{\tan(13°)} + \tan(13°+16°) = \frac{4.881}{1}$$

Thus, for every pound of additional axial force (after engagement) applied to the conical thread 52 an additional 4.88 pounds of radial compressive force is produced. As discussed above, this radial compressive force provides the secondary sealing means for the system.

Figure 9:
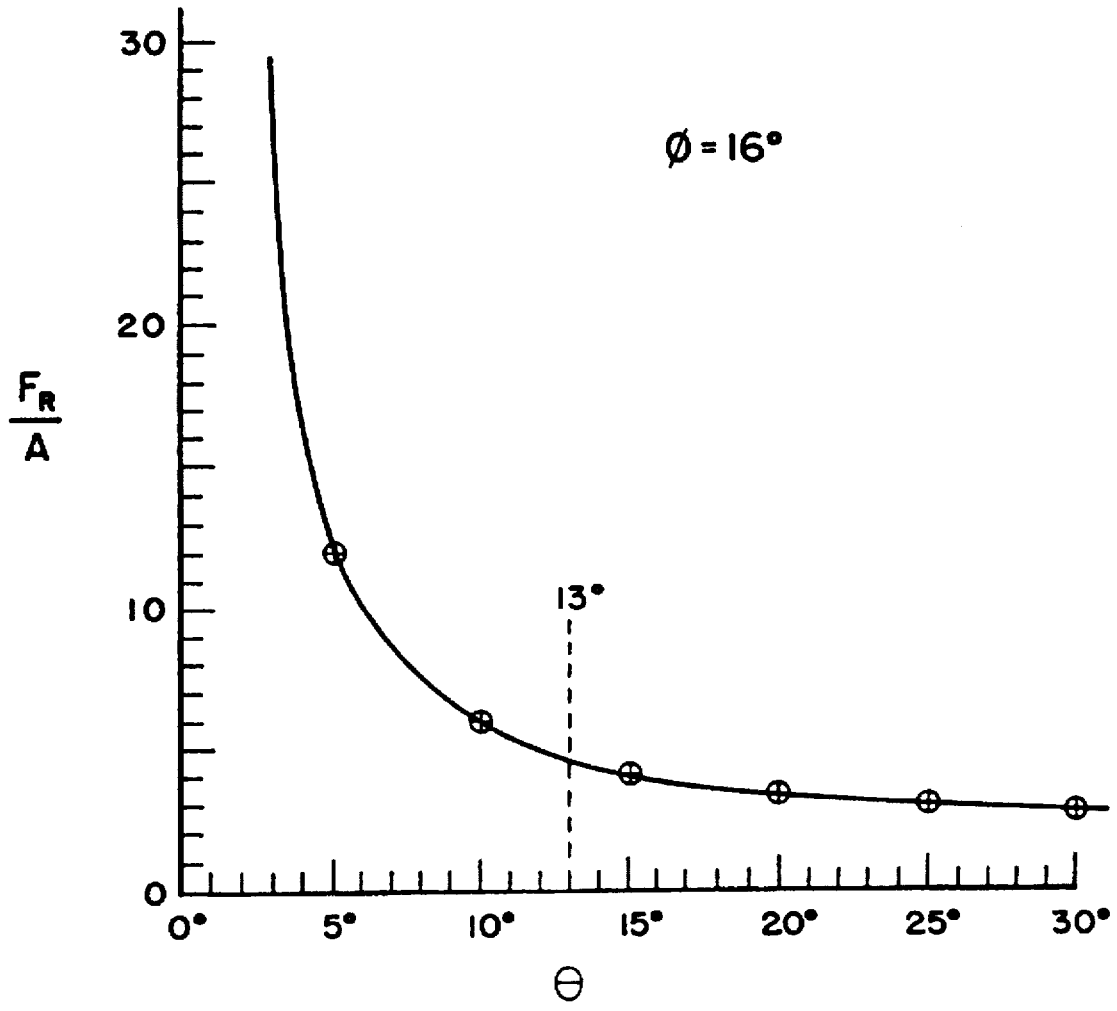
FIG. 9 is a graph of the ratio of radial compressive force to axial force as a function of the thread conical angle.
Figure 11:
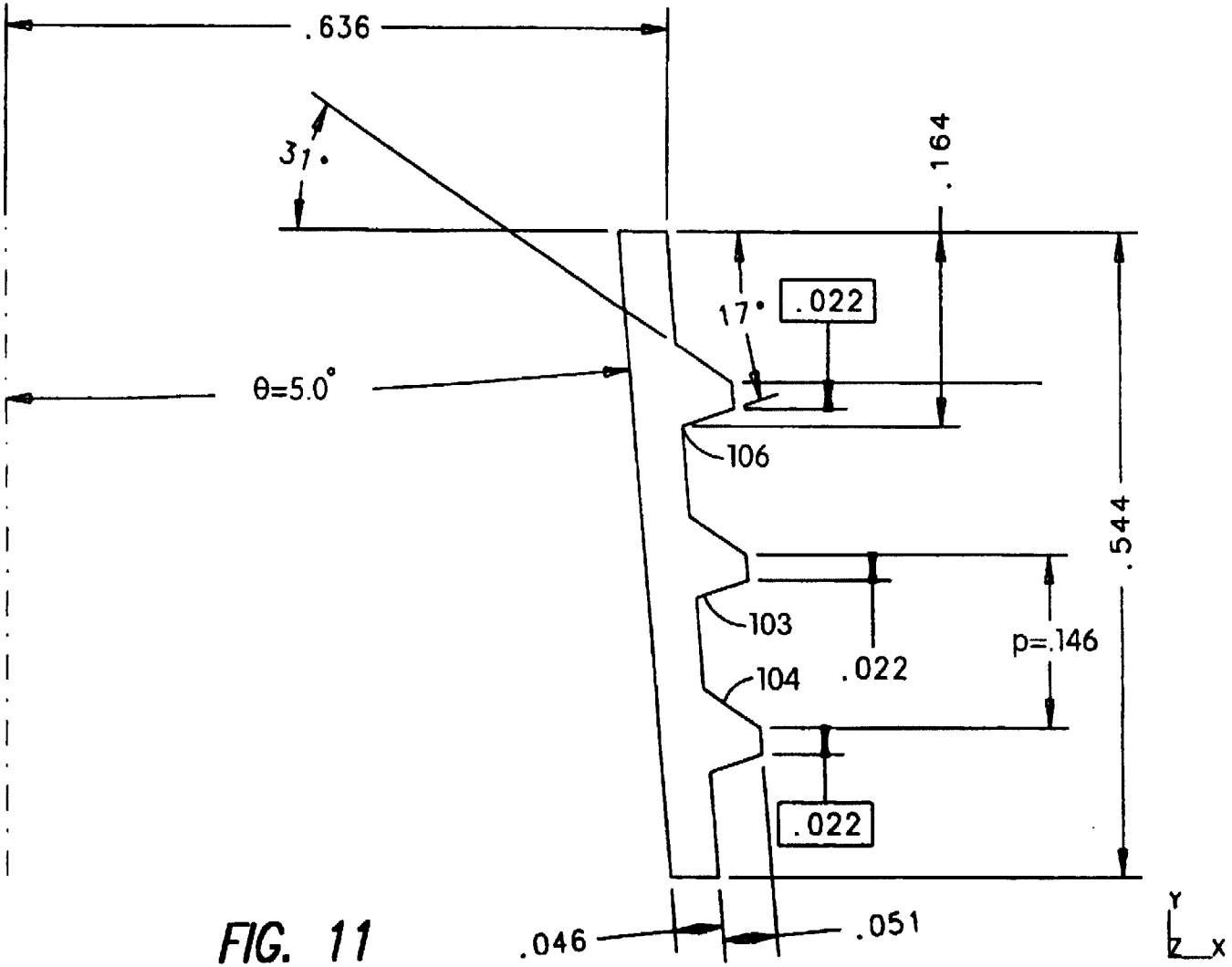
FIGS. 11 through 14 are simplified plan views of various container thread structures.
Figure 12:
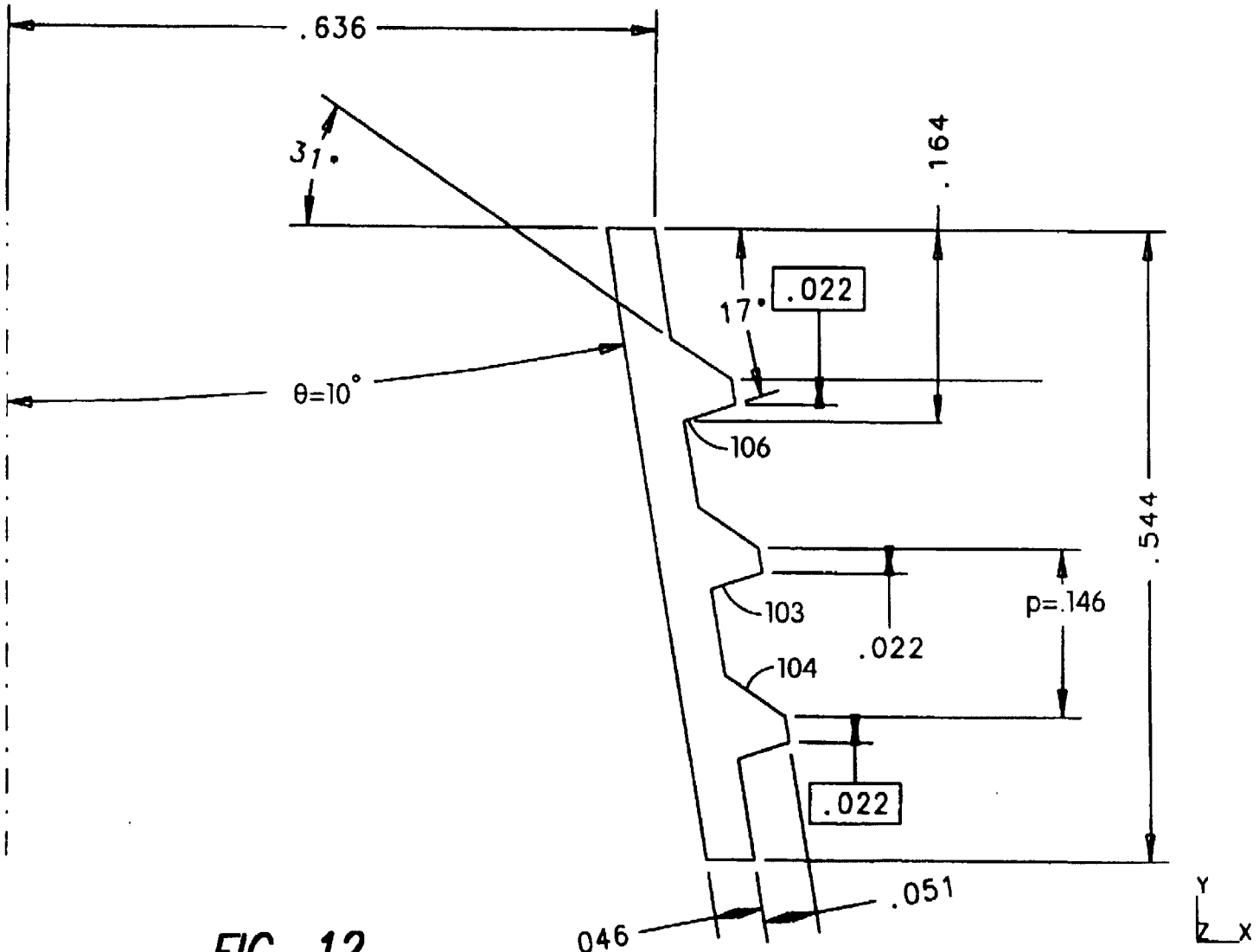
Figure 13:
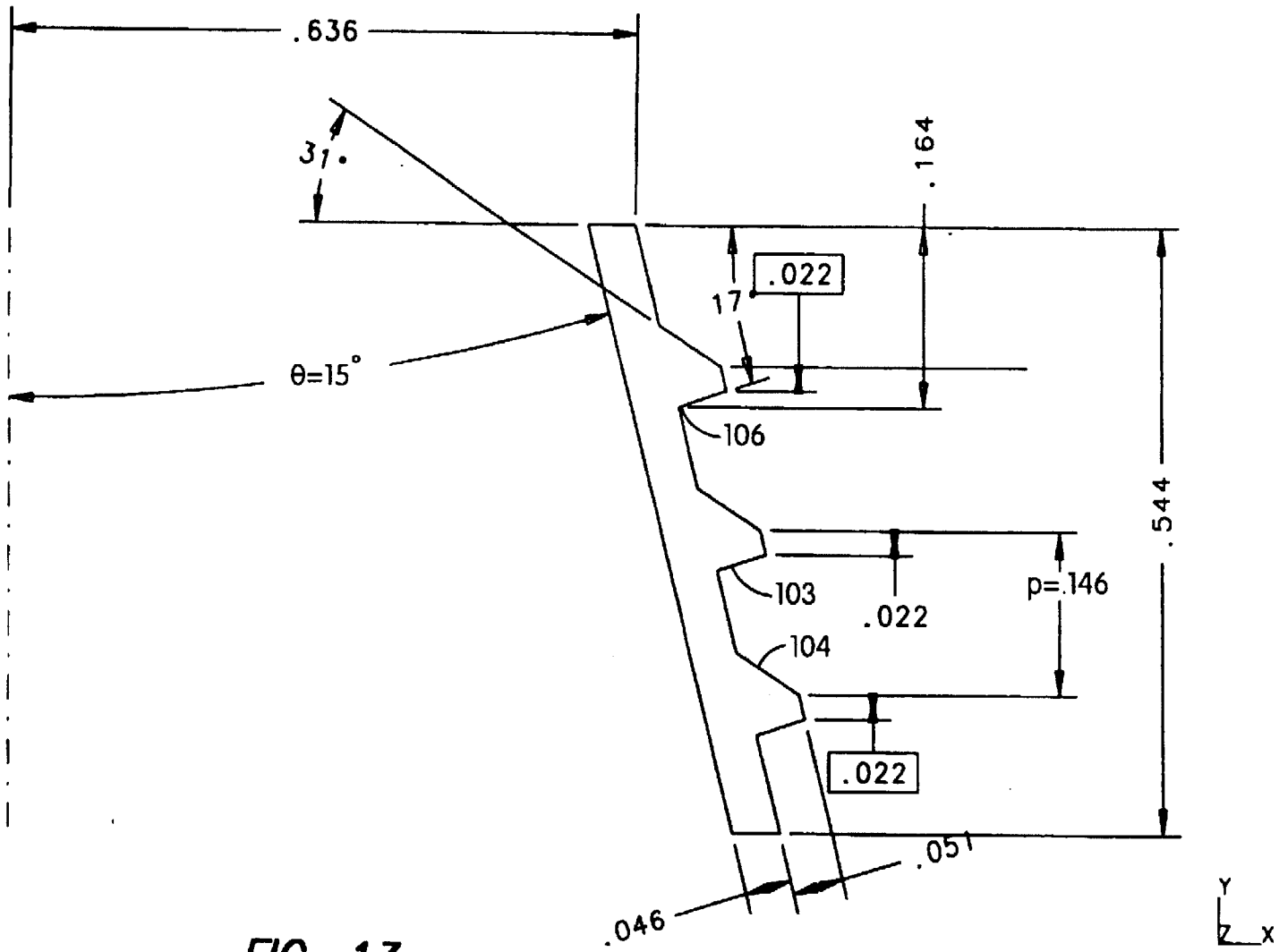
Figure 14:
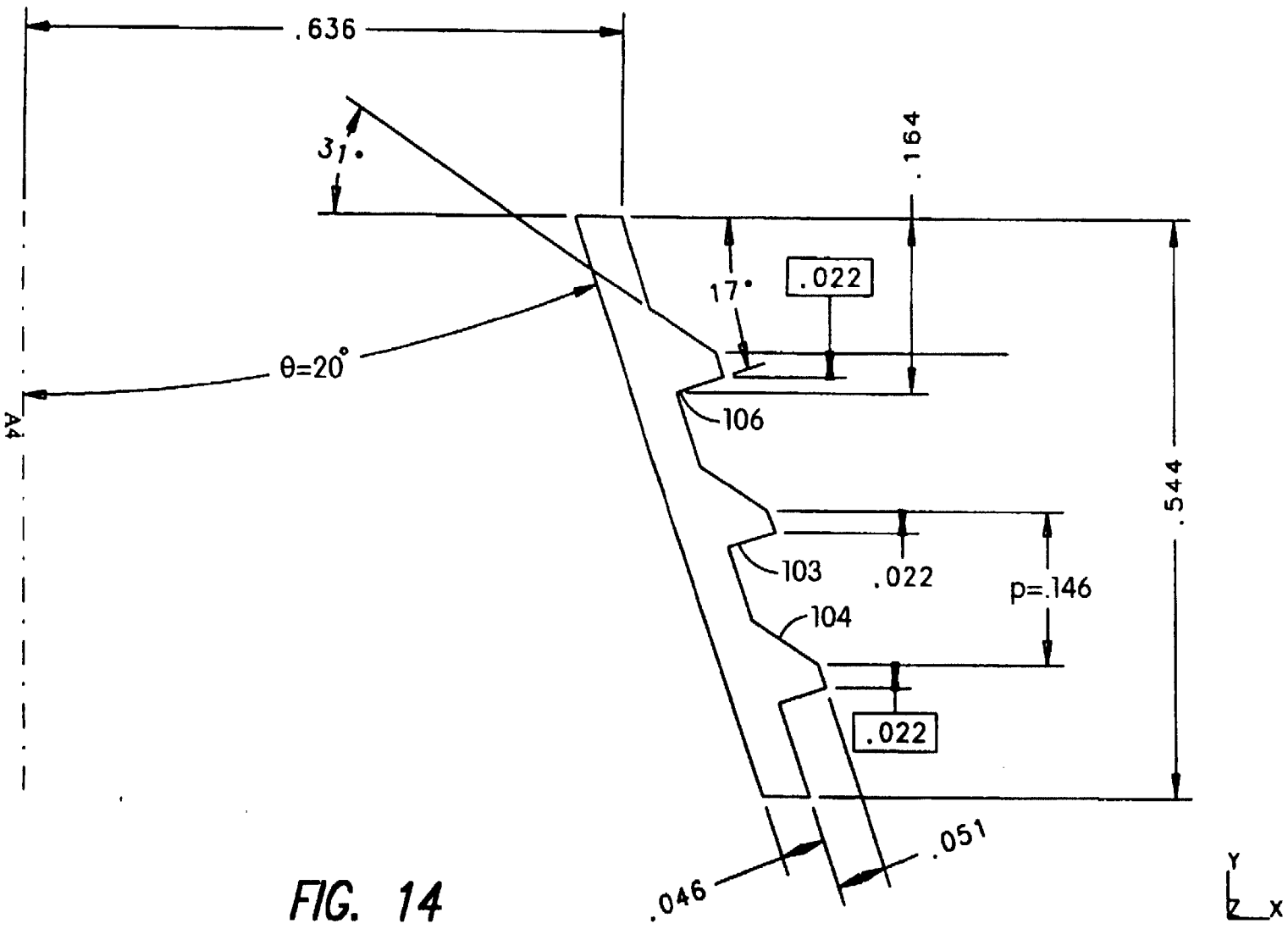

As illustrated in FIG. 9, as the thread angle θ increases, the ratio $F_R/A_Y$ decreases. As the thread angle θ decreases, the ratio $F_R/A_Y$ increases. However, it will be appreciated that smaller thread angles (i.e., ≦5°) require greater axial movement (of the cap) to generate the same amount of radial compressive force. Since there is only a limited amount of axial movement and the container and cap are typically designed to "bottom out" on the threads and cap top at approximately the same time, the full effects of the higher ratio $F_R/A_Y$ are never realized.

Applicants have accordingly found that the optimum conical angle (2×θ) is in the range of 20° to 30°, preferably 24°–28°, more preferably 26°. The noted conical angle provides an optimum ratio $F_R/A_Y$ in the range of 4.3–6.2:1 which, by virtue of the unique thread structures, is fully realized by the system.

To further illustrate the advantages of the invention, the following examples are provided. The examples are for illustrative purposes only and are not meant to limit the scope of the claims in any way.

EXAMPLES

A computer simulated stress analysis, employing an advanced finite element program, was conducted to assess the effects of varying the container conical thread angle δ on the tensile and compressive stresses.

Referring to FIG. 10, there is shown the three dimensional finite element mesh employed for the computer simulation. To simplify the analysis, the filet radiuses were eliminated from the thread profile.

As illustrated in FIG. 10, the container thread structure was modeled as three independent annular rings at four conical thread angles: 5°, 10°, 15° and 20°. The thread dimensions employed for the analysis are set forth in FIGS. 11 through 14.

The thread structure was loaded as follows: 70% of the load was on the first (top) thread 102, 20% of the load was on the second thread 103 and 10% of the load was on the third thread 104 (see FIG. 10). The load (i.e., pressure force) was applied uniformly on the thread structure bottom face 106 (see FIG. 15). At each conical thread angle investigated, the thread load was varied to account for differences in the projected area of the thread structure as the conical thread angle was varied.

The load was based on the following equation:

Force=torque (in. lbs.)/pitch diameter (in.)×friction coefficient

For purposes of the analysis, the following values were employed:

Torque=30 in. lbs.

Pitch Diameter=1.5 in.

Friction Coefficient=1.5

The compressive radial load was calculated as a percent of the axial load (based upon the sine of the pitch angle). For the four conical thread angles investigated 5°, 10°, 15° & 20°, the compressive radial component was 9%, 17%, 26% and 34%, respectively, of the axial force. The compressive radial component was uniformly distributed across the face of the thread structure.

FIGS. 15 through 22 provide the graphical results (plots) generated by the finite element program. Each Figure provides a color plot representing the stress regions on the container thread structure in three dimensions. The magnitude of the Von Mises Stress (indicated on the bar graphs) is however only approximate and, hence, for illustrative purposes only—comparisons of Von Mises Stress distribution as a function of conical thread angle.

For each conical thread angle investigated, two color plots were generated: (i) An XY plot showing a cross-section of the thread structure and an internal portion of the container and (ii) a XZ plot showing the outside surface of the container.

FIGS. 15 through 22 also show the original computer generated mesh 108 with zero strain and the thread structure 100 with the axial and radial loads applied. The displacement of the colored model from the green mesh is proportional to the strain. The amount of strain is however highly amplified ($\approx 5\times10^6$) for purposes of illustration.

Example 1

Computer simulation of stresses for a 5° conical thread structure

Figure 15:
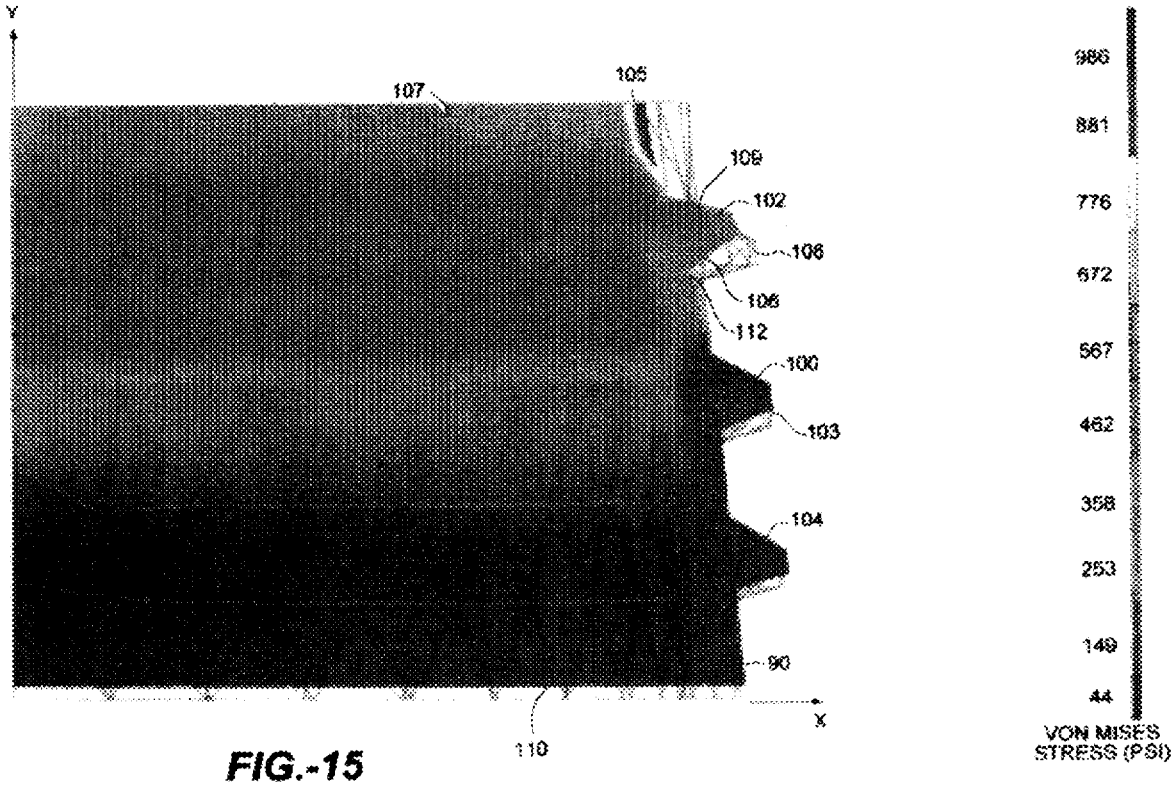
FIGS. 15 through 22 are stress plots illustrating computer simulations of thread structure stress distribution for various conical thread angles.
Figure 16:
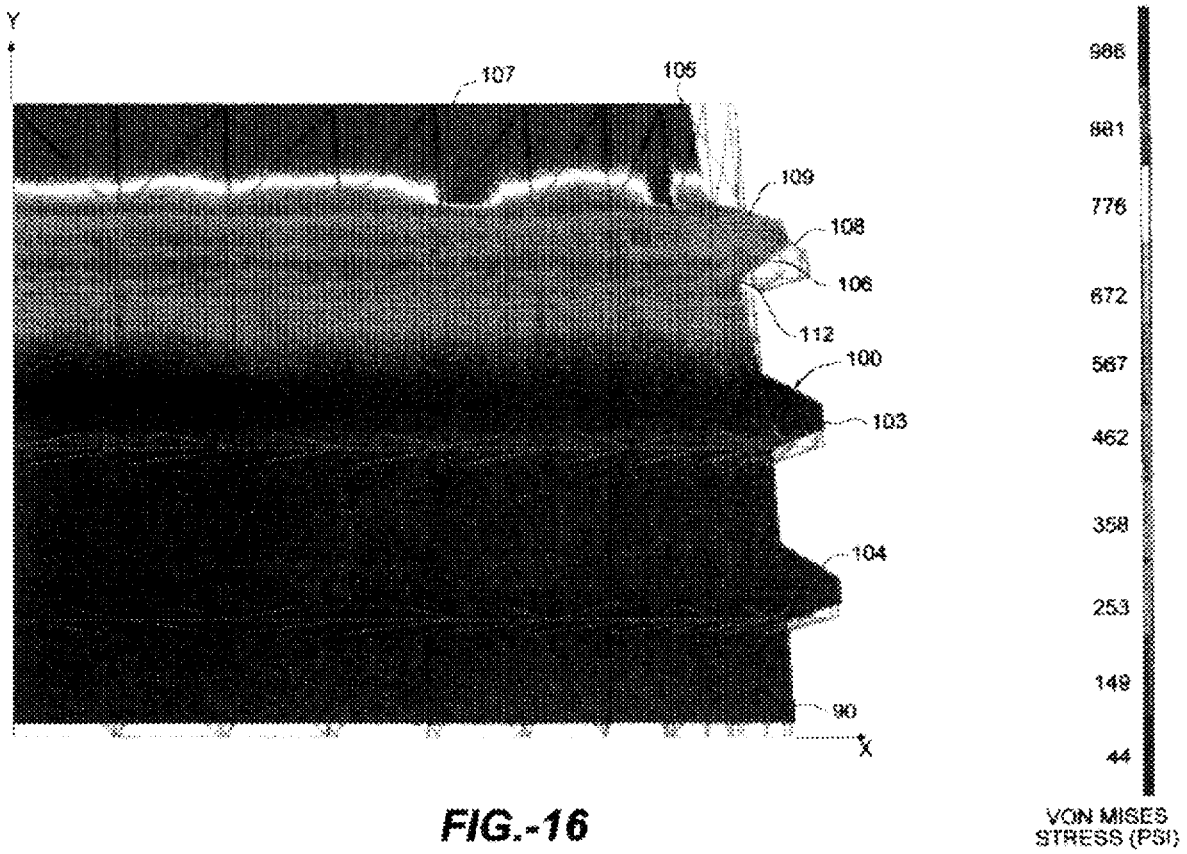

Referring to FIGS. 15 and 16, there are shown the graphical results of the finite element stress analysis for a 5° conical thread structure. FIG. 15 is a (XY) plot of a quadrant of the container thread structure 100 showing a cross-section of the thread structure 100 and an internal portion 110 of the container 90. FIG. 16 is a (YZ) plot showing the outside of the container 90.

Due to the small compressive radial component, the 5° computer simulation indicates only a slight reduction (≈5%) in stress proximate the root 112 of the first or top thread 102. FIG. 16 also indicates a slight increase in compressive load at the outside lip 105 of the container top surface 107.

Example 2

Computer simulation of stress for a 10° conical thread structure

Figure 17:
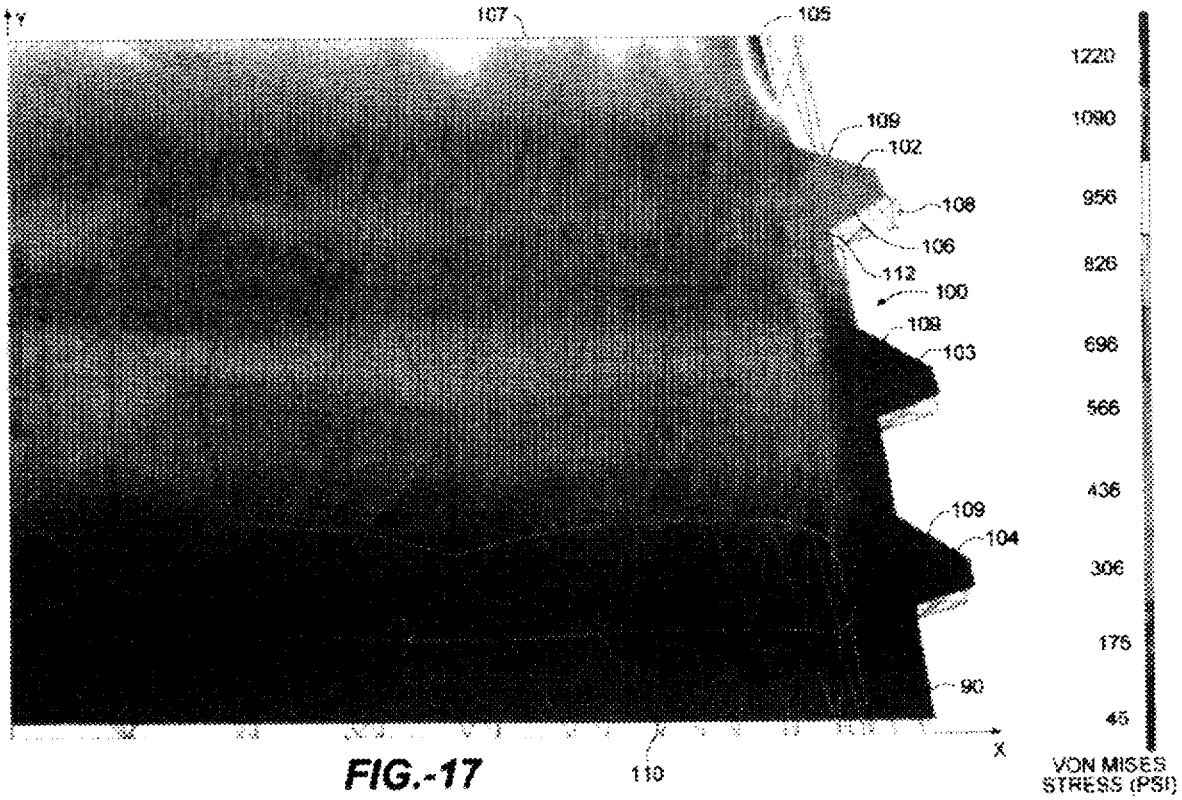
Figure 18:
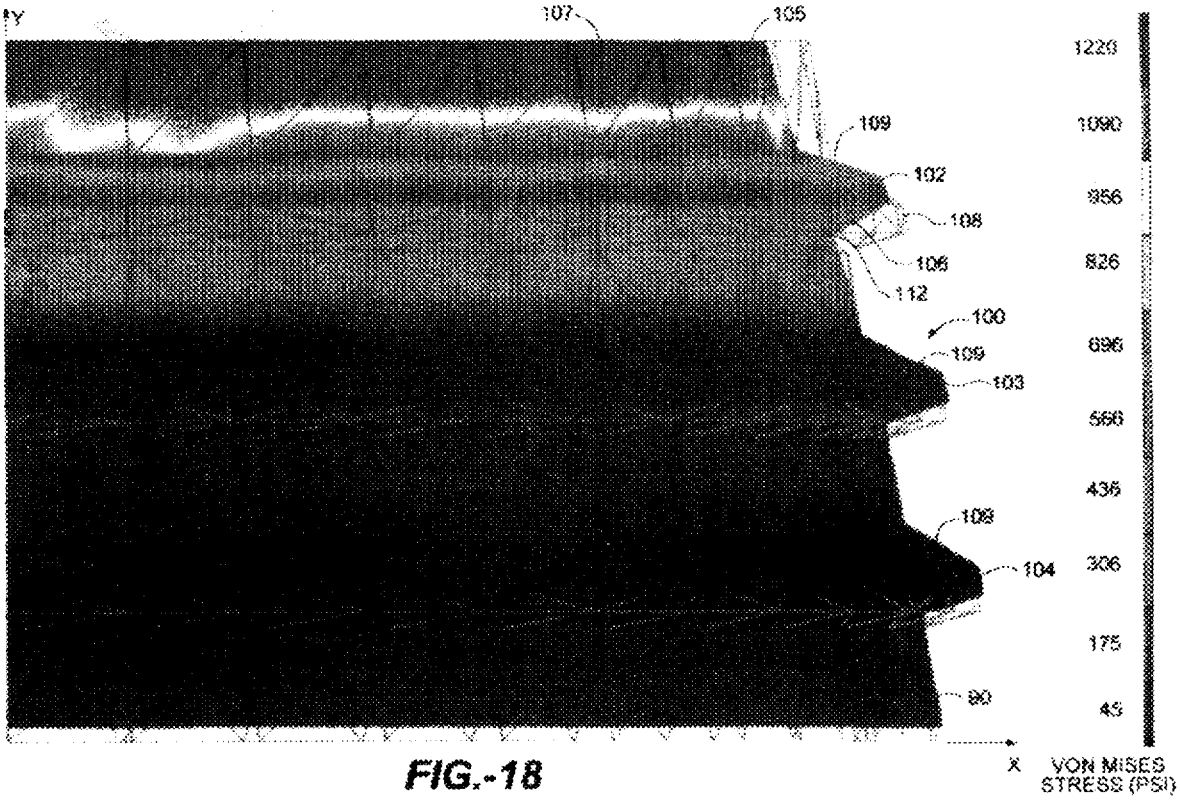

As illustrated in FIGS. 17 and 18, the largest reduction in stress (proximate the root 112 of the first thread 102) was achieved by virtue of the 10° conical thread angle. As indicated by the computer simulation, the stresses were reduced approximately 15%–17%. Also significant is the increased stress at the opening of the container 107 which is achieved without an increase in the clamping force (see FIG. 18). As discussed in detail herein, the noted stress increase (i.e., clamping force) enhances the primary sealing of a container/cap assembly.

FIGS. 17 and 18 further indicate a significant amount of strain proximate the upper face 109 of the threads 102, 103, 104 by virtue of the thread angle. The noted strain (magnified for purposes of illustration) reflects the region of plastic flow of the thread structure which provides the unique secondary sealing means according to the invention.

Example 3

Computer simulation of stress for a 15° conical thread structure

Figure 19:
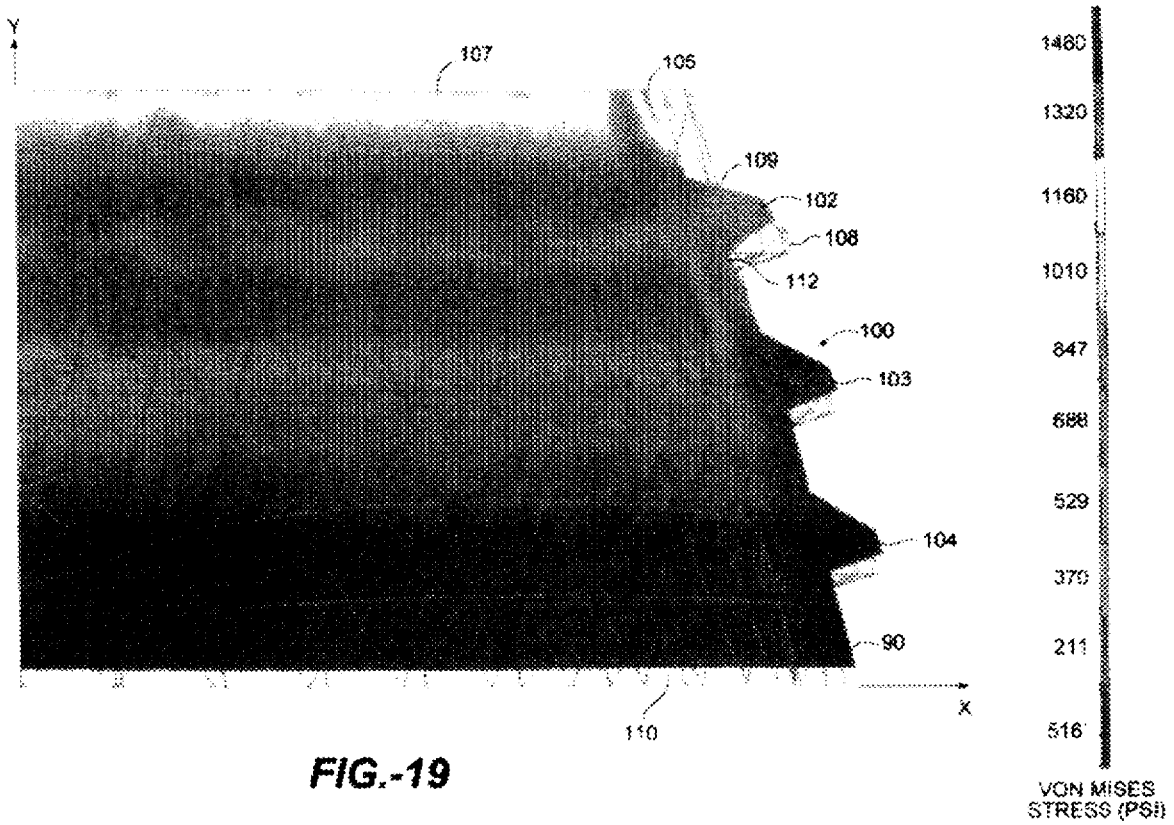
Figure 20:
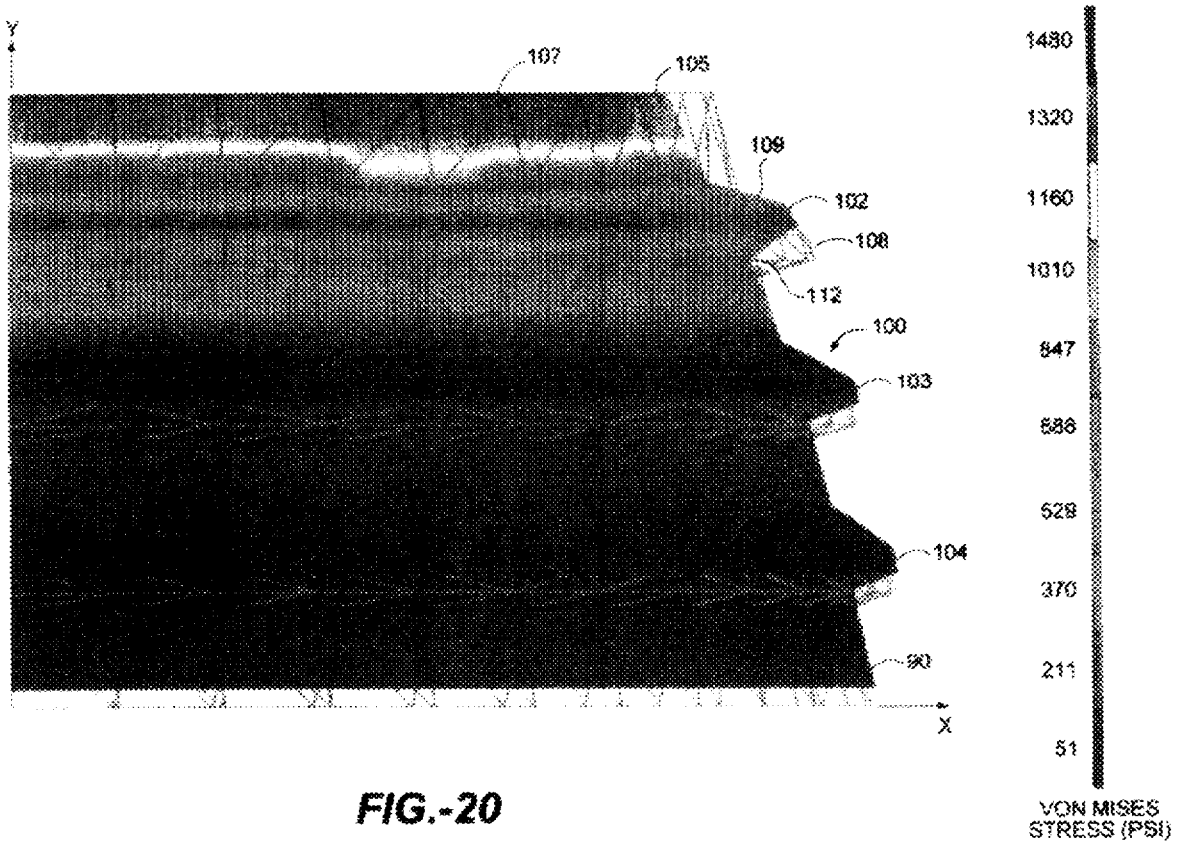

Referring now to FIGS. 19 and 20, there are shown the graphical results of the stress analysis for a 15° conical thread structure. FIGS. 19 and 20 also indicate a significant reduction in stress magnitude (≈8%–10%) by virtue of the conical thread angle.

FIGS. 19 and 20 also indicate a significant amount of strain proximate the first thread 102.

Example 4

Computer simulation of stress for a 20° conical thread structure

Figure 21:
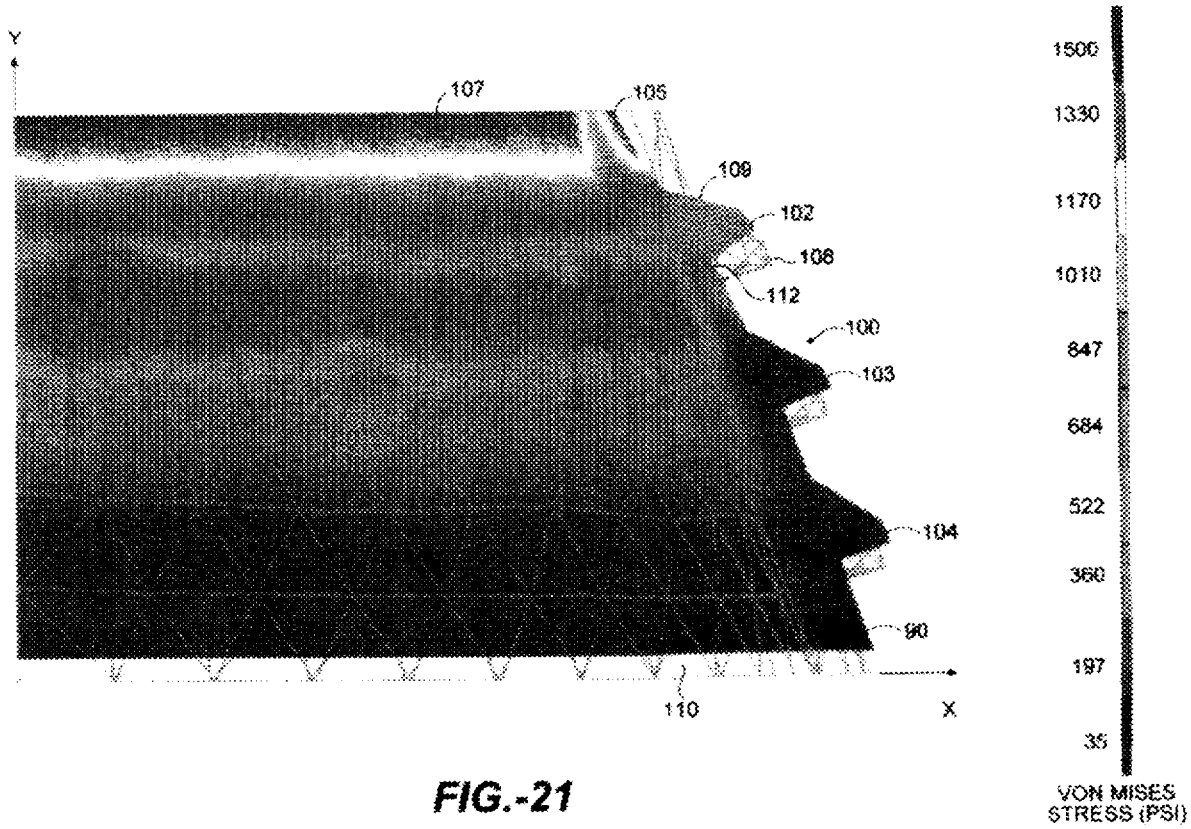
Figure 22:
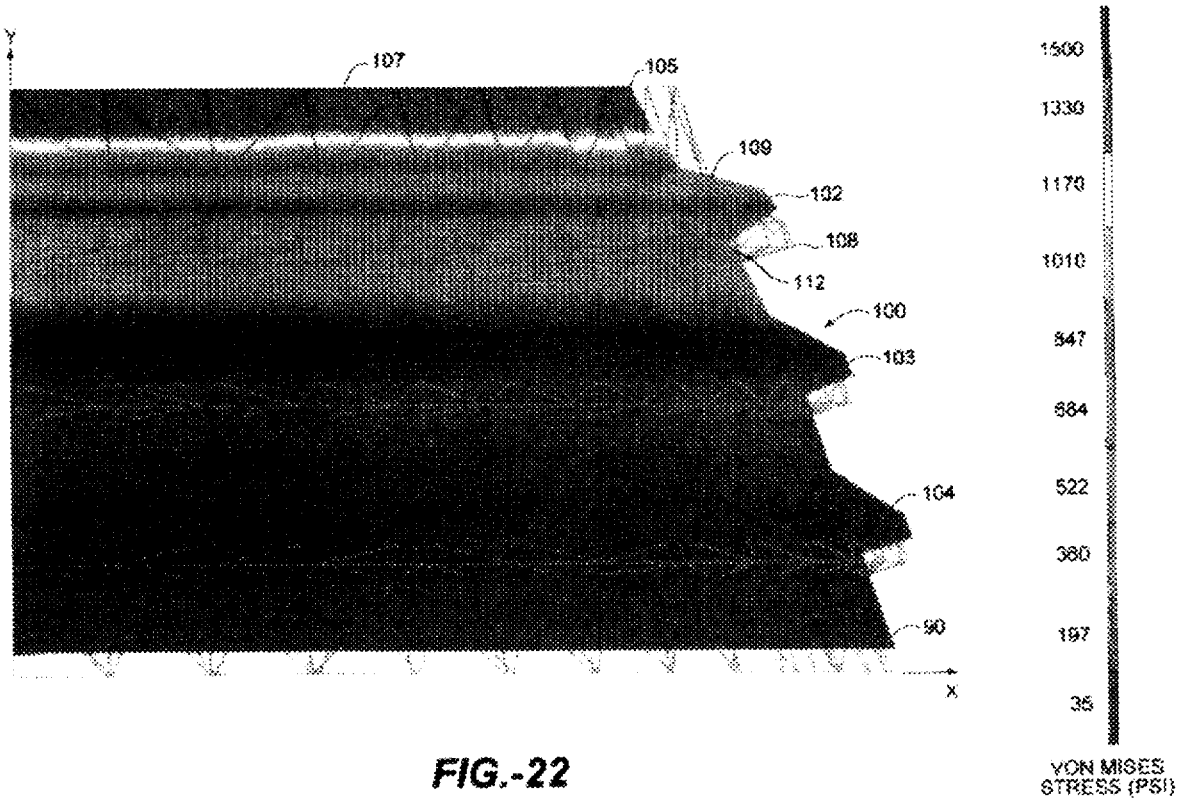

Referring now to FIGS. 21 and 22, there are shown graphical results of the stress analysis for a 20° conical thread structure. FIGS. 21 and 22 indicate that there is little difference in the stress levels proximate the first thread 102 for a 20° conical thread structure and the base line cylindrical thread. There is however a reduction in stresses in the lower threads 104.

The slight reduction in stress across the thread structure is a result of a decrease in the radial (component) force (see FIG. 9).

Figure 23:
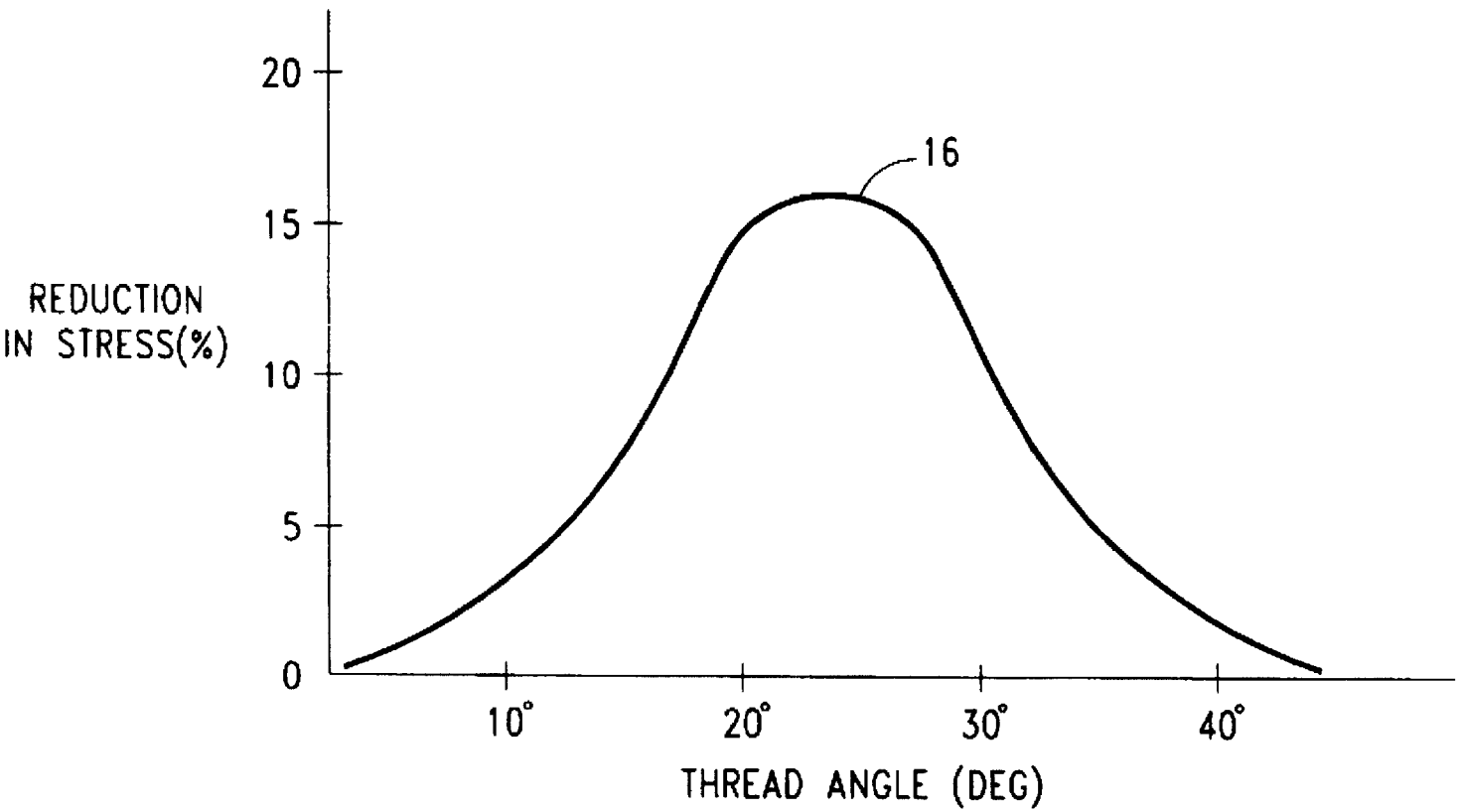
FIG. 23 is a graph of percent reduction in stress versus thread angle.

Referring now to FIG. 23, there is shown a graphical illustration of the results of the computer simulated stress analysis showing the percent reduction in stress as a function of conical thread angle. As indicated, the optimum conical thread angle δ to achieve the greatest overall reduction in stresses is in the range of 10° to 15°. The noted conical thread angle further provides optimum primary and secondary sealing means according to the invention.

It will thus be appreciated that the resultant stress distribution of the conical thread structures of the invention has numerous, significant advantages. Among the advantages is a significant reduction in the amount of axial force required to seal the container.

Further, since (i) the applied forces are reduced, (ii) a greater portion of the thread area is in a compressive mode and (iii) the moments at the thread roots are substantially reduced, problems generally associated with creep are substantially reduced or eliminated. Thus, thinner polymers or low density polymeric materials may be employed.

Moreover, for the same amount of torque or rotational effort, one is able to produce a greater axial force as compared to conventional cylindrical threads. Thus, any additional axial force required to maintain the integrity of the system seal can be readily accommodated.

SUMMARY

From the foregoing description, one of ordinary skill in the art can easily ascertain that the present invention provides a novel conically threaded closure system. The disclosed system, employing cooperating conical cap and container thread structures, provides a compressive radial force to axial force ratio in the range of 4.3–6.2:1 which results in (i) an optimum stress distribution throughout the thread structures, (ii) optimum thread engagement with minimal rotational effort and (iii) primary and secondary sealing means.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A threaded closure system, comprising:

a container having a substantially circular opening and a thread portion disposed proximate thereof, said container being constructed of a thermoplastic material, said thread portion including a first continuous conical thread structure having a conical angle in the range of approximately 20° to approximately 30°; and a cap having a substantially circular top and a depending cap skirt, said top including an outer surface and an interior surface, said top having a correspondingly similar shape and dimension as said container opening, said cap skirt having a correspondingly similar second continuous conical thread structure disposed on the inside surface thereof which directly engages said first conical thread structure, said second conical thread structure having a conical angle in the range of approximately 20° to approximately 30°;

said container opening and said interior surface of said cap top being sealably engaged upon said engagement of said first conical thread structure and said second conical thread structure, and sealable engagement of said container opening and said cap providing primary sealing means of the closure system;

said second conical thread structure producing plastic flow of said container thread portion upon said engagement of said first conical thread structure and said second conical thread structure, said plastic flow providing secondary sealing means of the closure system.

2. The closure system of claim 1, wherein said first conical thread structure and said second conical thread structure provide a ratio of radial compressive force to axial force in the range of approximately 4.2–6.3:1 upon said engagement of said first and said second conical thread structures.

3. The closure system of claim 1, wherein said first conical thread structure has a conical angle in the range of approximately 24° to approximately 28°.

4. The closure system of claim 3, wherein said second conical thread structure has a conical angle in the range of approximately 24° to approximately 28°.

5. The closure system of claim 1, wherein said container thread portion includes at least 2.5 turns of said first conical thread structure.

6. The closure system of claim 5, wherein said 2.5 turns of said first conical thread structure are engaged by said cap second conical thread structure upon 1 to 1.5 rotations of said cap.

7. The closure system of claim 1, wherein said cap includes a compressible liner disposed on the interior surface of said cap top.

8. The closure system of claim 1, wherein said container is constructed of polyethylene.

9. The closure system of claim 1, wherein said cap is constructed of a thermoplastic material.

10. The closure system of claim 9, wherein said cap is constructed of polyethylene.

11. The closure system of claim 9, wherein said cap is constructed of polypropylene.

12. A threaded closure system, comprising:

a container having a substantially circular opening and a thread portion disposed proximate thereof, said container being constructed of a thermoplastic material, said thread portion including approximately 2.5 full turns of a first continuous conical thread structure said thread structure having a conical angle in the range of approximately 24° to 28°; and a cap having a substantially circular top and a depending cap skirt, said top including an outer surface and an interior surface, said top having a correspondingly similar shape and dimension as said container opening, said cap being constructed of a thermoplastic material, said cap skirt including approximately 2.5 full turns of a correspondingly similar second continuous conical thread structure disposed on the inside surface thereof which directly engages said first conical thread structure, said second conical thread structure having a conical angle in the range of approximately 24° to 28°;

said container opening and said interior surface of said cap top being sealably engaged upon said engagement of said first conical thread structure and said second conical thread structure, said sealable engagement of said container opening and said cap providing primary sealing means of the closure system;

said engagement of said first conical thread structure and said second conical thread structure further providing a ratio of radial compressive force to axial force in the range of approximately 4.2–6.3:1 whereby said second conical thread structure produces plastic flow of said container thread portion upon said engagement of said first conical thread structure and said second conical thread structure, said plastic flow providing secondary sealing means of the closure system.

13. The closure system of claim 12, wherein said first conical thread structure has a conical angle of approximately 26°.

14. The closure system of claim 13, wherein said second conical thread structure has a conical angle of approximately 26°.

15. The closure system of claim 12, wherein said container first conical thread structure is fully engaged by said cap second conical thread structure upon 1 to 1.5 rotations of said cap.

16. The closure system of claim 12, wherein said cap includes a compressible liner disposed on the interior surface of said cap top.

17. The closure system of claim 1, wherein said cap has a substantially frustoconical shape.

18. The closure system of claim 12, wherein said first conical thread structure and said second conical thread structure have a substantially similar thread pitch of approximately 0.15 in.

19. The closure system of claim 18, wherein said first conical thread structure and said second conical thread structure have a substantially similar helix angle of approximately 16°.

* * * * *